US007385340B2

(12) United States Patent
Yamamizu et al.

(10) Patent No.: US 7,385,340 B2
(45) Date of Patent: Jun. 10, 2008

(54) LAMP ARRANGEMENT WITH A LAMP AND A BASE

(75) Inventors: Yutaka Yamamizu, Kanzaki-gun (JP); Shinobu Muraki, Kanzaki-gun (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 90 days.

(21) Appl. No.: 11/224,234

(22) Filed: Sep. 13, 2005

(65) Prior Publication Data

US 2006/0056183 A1 Mar. 16, 2006

(30) Foreign Application Priority Data

Sep. 16, 2004 (JP) ..... 2004-269526

(51) Int. Cl.
*H01J 5/54* (2006.01)
*H01J 5/50* (2006.01)

(52) U.S. Cl. ..... 313/318.01; 313/46; 313/41; 313/36

(58) Field of Classification Search ..... 313/493, 313/573, 623, 634, 318.01
See application file for complete search history.

(56) References Cited

U.S. PATENT DOCUMENTS 2,976,441 A 3/1961 Stahl
4,950,942 A 8/1990 Braum et al.
5,153,480 A 10/1992 Schoenherr et al.
6,465,949 B1 10/2002 Miahara et al.

FOREIGN PATENT DOCUMENTS

| | | |
|---|---|---|
| DE | G 8902247.5 U1 | 5/1989 |
| JP | 9-237611 | 9/1997 |
| JP | 11-162417 | 6/1999 |
| JP | 2004-273234 A1 | 9/2004 |
| JP | 2005-71689 A1 | 3/2005 |

*Primary Examiner*—Mariceli Santiago
(74) *Attorney, Agent, or Firm*—David S. Safran

(57) ABSTRACT

A lamp arrangement with a lamp and a base which is located on a hermetically sealed portion of the lamp. The base comprises a hollow cylindrical lamp holding part which holds and secures the hermetically sealed portion of the lamp, a bottom which borders the lower end of the lamp holding part, which end faces away from the lamp; and feed components which project from the back end face of the bottom, which end face faces away from the lamp. Between the lamp holding part and the bottom, a heat insulator is formed in which the amount of heat transferred in the axial direction of the base is less than the amount of heat transferred away from the base.

3 Claims, 5 Drawing Sheets

Fig. 4 (a)
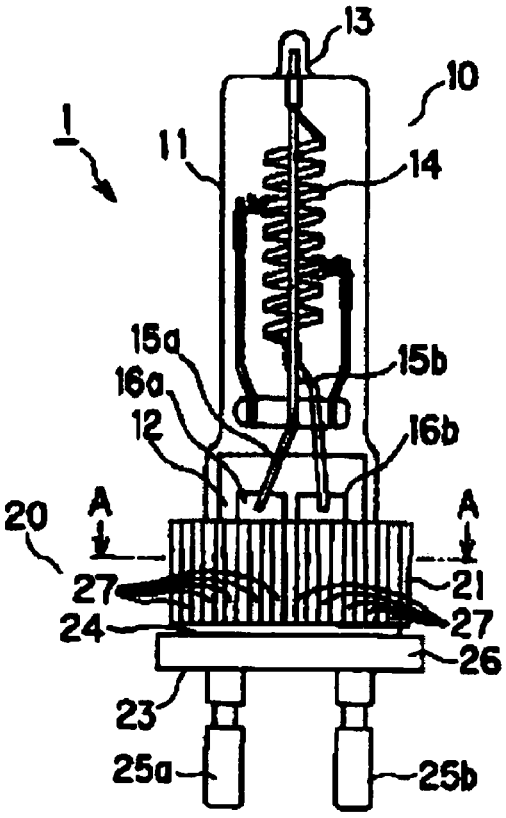
Fig. 4 (b)
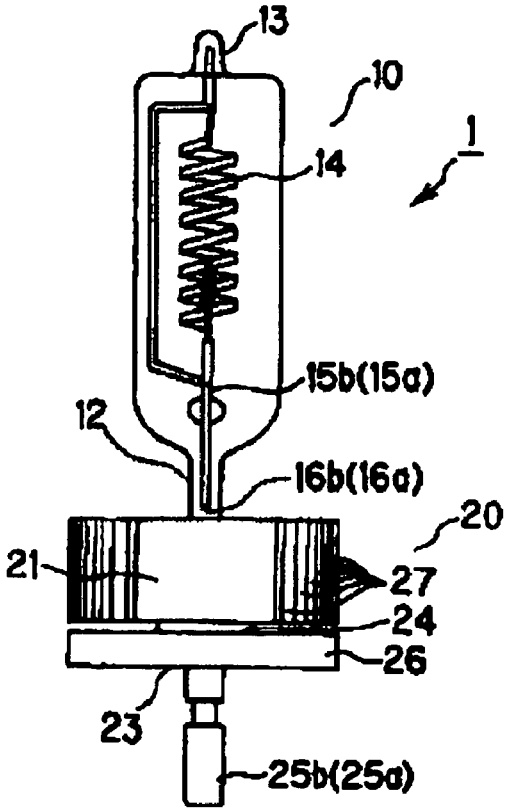
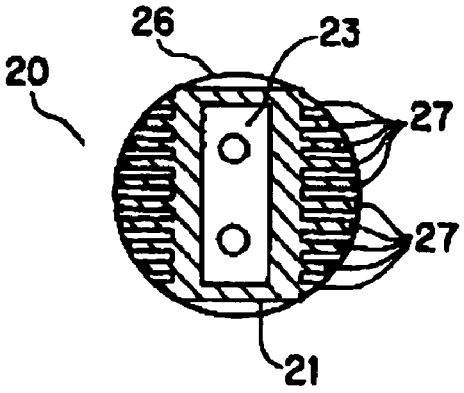
Fig. 5

LAMP ARRANGEMENT WITH A LAMP AND A BASE

BACKGROUND OF THE INVENTION

1. Field of the Invention

The invention relates to a lamp with a base on a hermetically sealed portion of the lamp.

2. Description of the Prior Art

A technique is known in which the light source for heating a semiconductor wafer is a filament lamp in which there is a base on a hermetically sealed portion. The semiconductor wafer is irradiated with light which contains IR radiation, and the temperature of the semiconductor wafer is thus quickly raised to a given temperature. This filament lamp with a base if formed, for example, essentially of a filament lamp with a so-called one-sided sealed termination in which, on one end of the arc tube, a hermetically sealed portion is formed, and of a ceramic base which holds the hermetically sealed portion of this filament lamp. By an arrangement of a host of filament lamps with a base on a frame on which there are a host of sockets next to one another, they are formed and used as a heating unit.

In the above described lamps with a base, a host of lamps are installed in the heating unit. Therefore, advantageously, a base is used which is provided with a feed component of the pin type corresponwhich can be easily installed in the socket and which can be easily detached from the socket, as is shown in FIG. 7, and is described in Japanese patent disclosure document JP HEI 11-162417 A.

FIG. 7 is a front view of a lamp which is provided with a base. The lamp 60 is, for example, a filament lamp in which a tungsten filament 62 is hermetically installed in an arc tube 61, and two inner lead pins 63*a*, 63*b* are connected to the two ends of the filament. The two inner lead pins 63*a*, 63*b* are, in turn, connected to metal foils 65*a*, 65*b* which are installed in the hermetically sealed portion 64. Outer lead pins 66*a*, 66*b* are connected to the metal foils 65*a*, 65*b* and extend outward from the hermetically sealed portion 64.

The hermetically sealed portion 64 of the lamp 60 is inserted into a rectangular hollow lamp holding part 67A of a base 67 and is attached by means of an adhesive. The outer lead pins 66*a*, 66*b* are welded to guide wires 68*a*, 68*b* that are formed of twisted nickel wires and they are electrically connected to a pair of feed pins 69*a*, 69*b* which project out of the bottom 67B of the base 67.

In this lamp which is provided with a base, the base 67 is held by a socket S which is installed in a frame D. By connecting the guide pins 69*a*, 69*b* to the feed connecting parts 70*a*, 70*b* in the socket S, power is supplied from a power source (not shown).

The contact areas between the feed pins of the base and the socket are locations at which the temperature is slightly increased due to electrical resistances and the like because the above described lamp with a base is operated at an increased current value. The heat which is stored in the vicinity of the feed pins normally moves via the socket which holds the base to the frame in which this socket is installed, by which heat is dissipated. However, for semiconductor production, since the amount of light emitted by the filament of the above described lamp is very large, the frame and the socket are heated by the light to a high temperature, by which there is no longer a temperature gradient between the feed pins, the socket and the frame. There is the disadvantage here that the heat of the feed pins is not dissipated via the socket to the frame. The feed pins cause an unduly high temperature increase, by which they are oxidized before their service life expires; this has many highly adverse effects on the lamp.

If the feed pins are being oxidized, between the feed connecting parts in the socket and the feed pins, the value of the electrical resistance is always set to a high value; this causes a temperature increase of the hermetically sealed portion and of the socket of the lamp and a reduction of the lamp efficiency which ultimately leads to cessation of lamp operation.

SUMMARY OF THE INVENTION

A primary object of the invention is to devise a lamp which is provided with a base with a long service life in which the feed components of the base are prevented from being overheated and oxidized and in which premature cessation of lamp operation is avoided.

The above described object is achieved in accordance with the invention in a lamp in which the hermetically sealed portion of the lamp is provided with a base, in that the above described base comprises the following:

- a hollow cylindrical lamp holding part which holds and secures the hermetically sealed portion of the lamp;
- a bottom which borders the lower end of the lamp holding part; and
- feed components which project over the back end face of the bottom, and that, furthermore, between the lamp holding part of the base and the bottom, a heat insulator is formed in which the amount of heat transferred in the axial direction of the base is less than elsewhere.

Additionally, the object is achieved in that the heat insulator is formed by the wall thickness of the lamp holding part being locally reduced.

The object is also achieved in that the heat insulator is made of a material with a coefficient of thermal conductivity which is less than that of the base material comprising the other components, especially other components which are located in the vicinity of the heat insulator.

The object is, furthermore, achieved in that the bottom of the base is formed as a heat radiation part.

Still further, the object is achieved in that the lamp holding part of the base is provided with heat radiating fins.

ACTION OF THE INVENTION

The lamp with a base in accordance with the invention yields the following effects:

Even if the heat from the hermetically sealed portion is transferred to the lamp holding part of the base which is located on the hermetically sealed portion of the lamp, or even if the lamp holding part is heated by the light which has been emitted from the lamp, the heat is poorly transferred to the bottom of the base since a heat insulator is formed in which the amount of heat transferred in the axial direction of the base is less than elsewhere. Thus, a temperature increase of the feed components is prevented.

As a result, it becomes possible to prevent the feed components at the base from exceeding the heat stability temperature. Thus, the contact state between the feed components and the feed connecting parts of the base can always be kept in the optimum state without oxidation of the feed components, and a lamp which is provided with a base with a long service life without cessation of lamp operation can be achieved.

The invention is described in detail below with reference to several embodiments shown in the accompanying drawings.

BRIEF DESCRIPTION OF THE DRAWINGS

FIG. 1(*b*) is a schematic representation of an example of the arrangement of a lamp of the invention with a base of FIG. 1(*a*) in a side view;

FIG. 3(*b*) is a schematic representation of the FIG. 3(*a*) embodiment in a side view;

FIGS. 4(*a*) & 4(*b*) are front and side views, respectively, showing still another embodiment of the invention;

FIG. 5 shows the base of a lamp with a base as shown in FIG. 4(*a*), in a cross section taken along the line A-A in FIG. 4(*a*), FIGS. 6(*a*) & 6(*b*) are front and side views, respectively, showing still another embodiment of the invention.

DETAILED DESCRIPTION OF THE INVENTION

Figure 1:
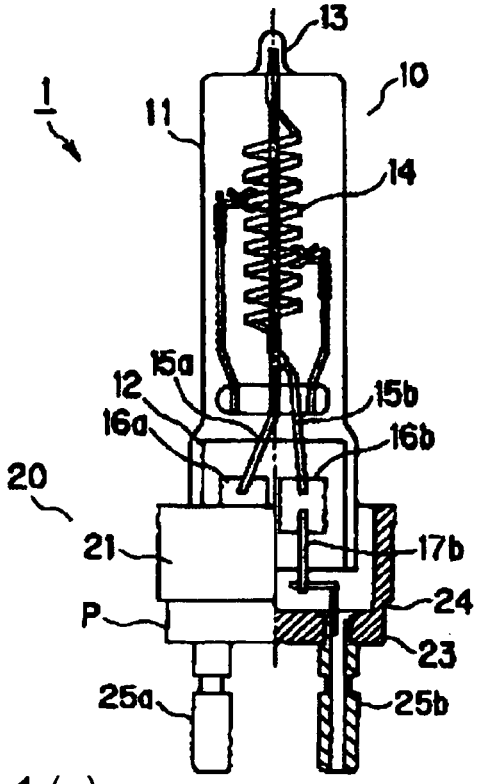
FIG. 1(*a*) is a schematic representation of an example of the arrangement of a lamp in accordance with the invention with a base using a filament lamp in a front view.
Figure 1:
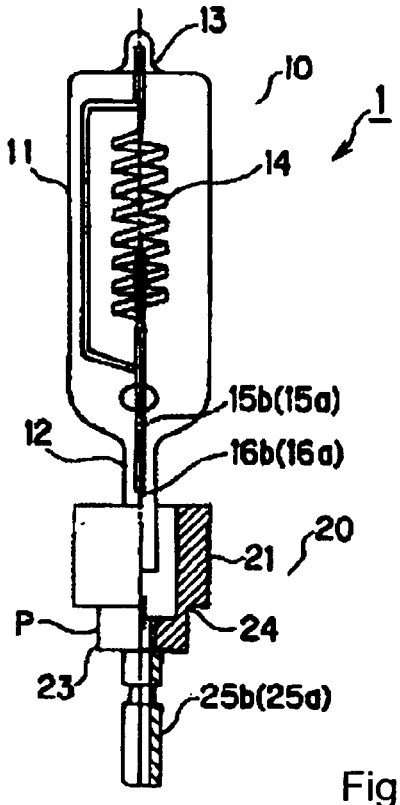
Figure 2:
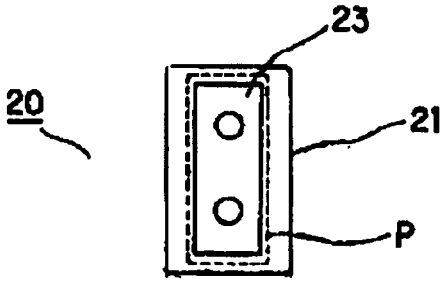
FIG. 2 is a top view of the base shown in FIGS. 1(*a*) & 1(*b*) with illustration of the side of the filament lamp.

FIGS. 1(*a*) & 1(*b*) are front and side views, respectively, of an example of the arrangement of a lamp with a base in accordance with the invention, using the example of a filament lamp. Both figures are partial cross sections to facilitate understanding. FIG. 2 shows a plan view illustrating only the base as shown in FIGS. 1(*a*) & 1(*b*) from the side of the filament lamp. The socket which is provided with the base is not further described below because it is identical to that as described above in connection with FIG. 7.

This lamp 1 with a base comprises a filament lamp 10 with one-sided sealed termination and a base 20 which is made of a ceramic material, for example, aluminum oxide. The filament lamp 10 has an arc tube 11, one end of which is provided with a hermetically sealed portion 12 and the other end of which merely has the remainder of an outlet tube 13. Additionally, there is a light emitting part 14 formed by tungsten filament that extends along the center longitudinal axis of the arc tube 11. The arc tube 11 is filled with an inert gas which contains, for example, nitrogen gas and a halogen compound.

An inner lead pin 15*a* is connected to the end of the light emitting part 14, while the other inner lead pin 15*b* is connected to the other end. The inner lead pins 15*a*, 15*b* extend into the hermetically sealed portion 12, and the respective end in the hermetically sealed portion 12 of the arc tube 11 is connected to a respective metal foil 16*a*, 16*b*, which are installed spaced apart from one another. The other end of one inner lead pin 15*a* is inserted into the remainder of the outlet tube 13 of the arc tube 11 and held there. An outer lead pin 17*b* is connected to the metal foil 16*b* and extends to the outside from the hermetically sealed portion 12. The metal foil 16*a* is connected accordingly to another outer lead pin (not shown).

The base 20 has a hollow corner cylindrical lamp holding part 21 with an opening, a bottom 23 which borders the back end of this lamp holding part 21 and a heat insulator 24 which is formed between the bottom 23 and the lamp holding part 21. The term "heat insulator" is defined as a part which obstructs heat conductivity.

This heat insulator 24 is formed by an arrangement of a step part P in the vicinity of the bottom 23 of the lamp holding part 21 over the entire periphery, at the step part P the outer peripheral area of the lamp holding part 21 is cut off such that the wall thickness of the lamp holding part 21 is decreased locally.

On the bottom 23 of the base 20, two feed pins, as feed components 25*a*, 25*b*, are attached to the socket and are formed so as to project to the outside. The outer lead pins 17*a*, 17*b* are electrically connected to the feed pins in a filament lamp 10 via guide wires, for example, formed of twisted nickel wires.

In the lamp 1 with a base with the above described arrangement, in the vicinity of the bottom 23, at the lamp holding part 21, the heat insulator 24 is formed so as to obstruct the transmission of heat which is directed from the tip of the base 20 in the direction toward the back end. The "tip of the base" here means the end of the base facing the lamp, "bottom" means the end facing away from the lamp. The heat transferred by the hermetically sealed portion 12 and the heat which was stored as the light emitted by the lamp 10 is absorbed on the lamp side of the lamp holding part 21 are therefore only poorly transmitted in a direction toward the vicinity of the bottom 23 of the base 20, so that the temperature of the feed components 25*a*, 25*b* does not increase and oxidation thereof can be prevented.

Since the feed components are not oxidized, the contact state between the feed parts and the feed connecting parts of the socket can always be optimally maintained and cessation of lamp operation avoided. Thus, a lamp which is provided with a base with a long service life can be obtained.

Figure 3:
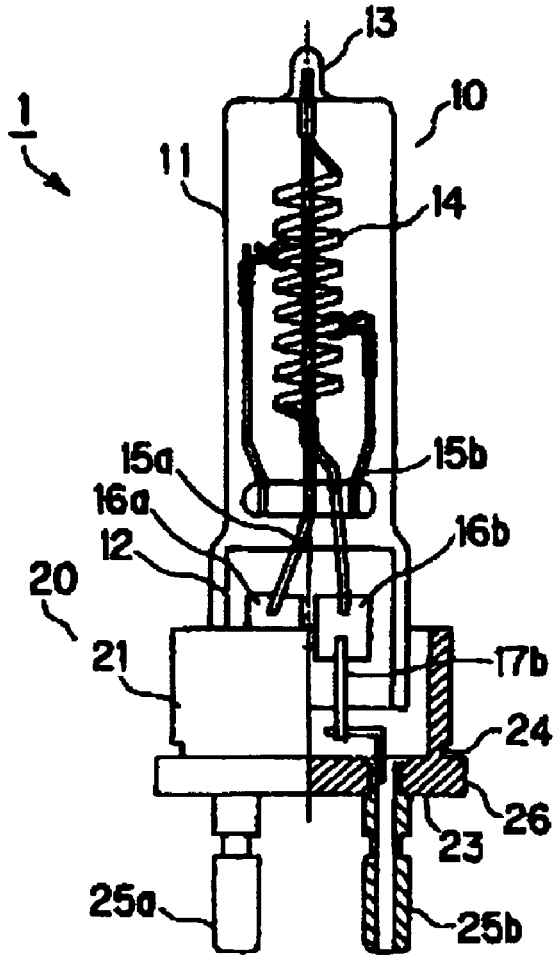
FIG. 3(*a*) is a schematic representation of another embodiment in a front view.
Figure 3:
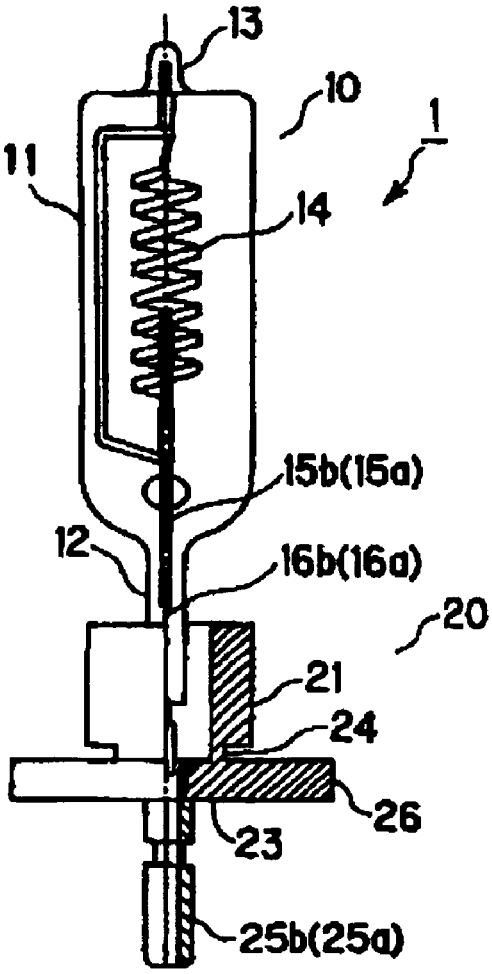

FIGS. 3(*a*) & 3(*b*) show another embodiment of the invention in front and side views, respectively. The same components as in the embodiment as shown in FIGS. 1(*a*), 1(*b*) & 2 are provided with the same reference numbers here and are not further described.

The difference between the lamp provided with the base of this embodiment and the lamp provided with the base according to the above described first embodiment is that, in this embodiment, there is a heat radiation part behind the heat insulator. In this embodiment, for example, the diameter of a section of the bottom 23 of the base 20 is locally enlarged, by which a part which is essentially at a right angle to the axial direction of the lamp with a relatively great width is formed and becomes a heat radiation part 26. Here, for the heat radiation part 26, enlarging the diameter of the outer periphery beyond the outer periphery of the lamp holding part 21, in a top view, prevents the light emitted by the lamp from being emitted directly onto the feed components 25*a*, 25*b*.

As was described above, by forming the heat radiation part 26 and enlarging its area, heat radiation of the base bottom 23 is accelerated. Furthermore, by the arrangement in which the light from the lamp is not emitted onto the feed components 25*b*, 25*b*, a temperature increase of the feed components 25*a*, 25*b* can be effectively prevented.

FIG. 4(*a*) & 4(*b*) show still another embodiment of the invention in front and side views, respectively. FIG. 5 shows a cross section of the base of the lamp in a view taken along line A-A in FIG. 4(*a*). The same components as in the embodiments shown in FIG. 1(*a*), 1(*b*) to FIGS. 3(*a*), 3(*b*) are provided with the same reference numbers and are therefore not further described.

The difference between the lamp provided with a base according to this embodiment and the lamp provided with a base according to the above described second embodiment is that a plurality of radiating fins 27 are provided on the outer peripheral surface of the lamp holding part at the base.

The arrangement of radiating fins according to the above described embodiment effectively radiates the heat of the lamp holding part, by which the temperature can be reduced. In the case of a lamp, for example, with a large rated power consumption and a relatively high temperature of the hermetically sealed portion, there is therefore the possibility that the base will be overheated by the heat transmitted from the hermetically sealed portion of the lamp. However, the heat transmitted to the heat insulator 24 can be reduced by the radiating fins 27. Therefore, the heat insulator 24 reliably enables a reduction of the heat transmitted to the feed components 25*a*, 25*b*.

Figure 6:
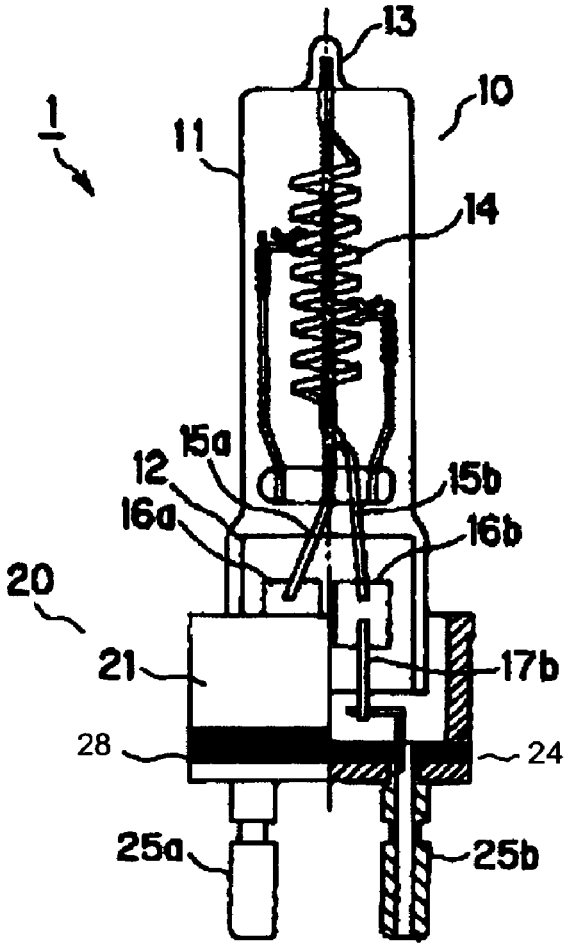
Figure 6:
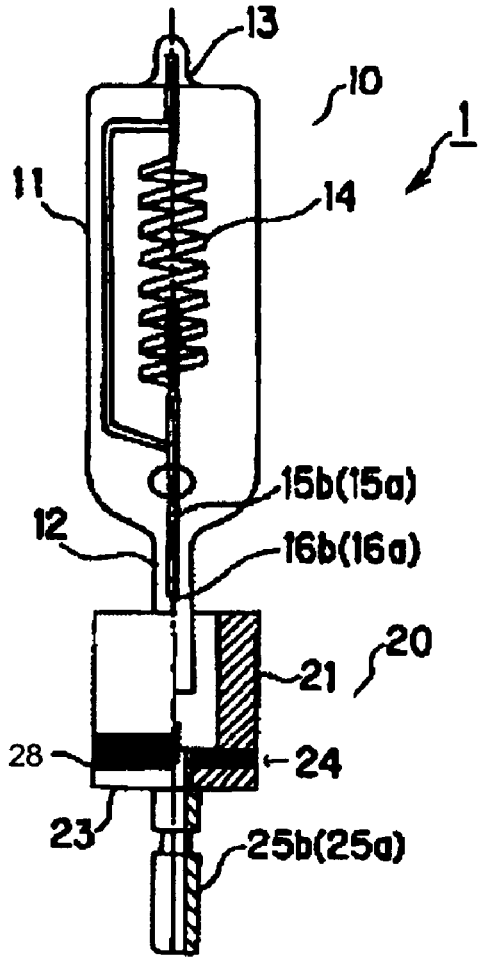

The invention is however not limited to the above described arrangements, but can be modified in a suitable manner. In the above described embodiment, for example, the heat insulator was formed by a local reduction in the thickness of the base. However, this same effect can also be obtained by, for example, a ceramic with a smaller coefficient of thermal conductivity than that of the ceramic comprising the lamp holding part being provided as an intermediate layer. This is shown in FIGS. 6(*a*) and 6(*b*) which, apart from the heat insulator, correspond to FIGS. 1(*a*) and 1(*b*). Here, the heat insulator 24 is a plate or layer 28 which is located above the bottom of the lamp holding part 21 and has essentially the same outer diameter as the lamp holding part 21. However, as the heat insulator is made of a material having a lower coefficient of thermal conductivity than the material of the lamp holding part the heat transmitted to the feed components 25*a*, 25*b* is reduced. As mentioned above, ceramic is a preferred material for the layer or plate 28. In an alternative embodiment, the whole bottom area can be made of a material with a low thermal conductivity instead of providing only an intermediate layer.

EMBODIMENT 1

One embodiment of the lamp with a base of the invention is described below. A lamp provided with a base according to the first embodiment of FIGS. 1(*a*), 1(*b*) & 2 was produced under the conditions described below.

(Filament Lamp)
Arc tube: material: silica glass
total length: 150 mm
outside diameter: 27 mm
inside diameter: 25 mm
Filament: material: tungsten
Total length of light emitting part: 25 mm
Inner lead pin: material: tungsten
Metal foil: material: molybdenum
Filler: krypton gas, nitrogen and halogen compound
Rated voltage: 120 V
Rated power consumption: 500 W (Base)
Insulator part: material: aluminum oxide
total length: 50 mm
Opening in the lamp holding part: 13 mm×35 mm
Thickness of the lamp holding part: 6 mm
Thickness of the heat insulator: 2 mm

EMBODIMENT 2

Without changing the specification of the filament lamp according to the above described embodiment 1, a lamp provided with a base according to embodiment 2 with the arrangement shown in FIGS. 3(*a*) & 3(*b*) was produced. This means that the base according to the embodiment 2 has the same basic arrangement and the same dimensions as the base described in embodiment 1. Furthermore, here, the bottom of the base is provided with a heat radiation part with an enlarged diameter.

(Base)
Outside diameter of the heat radiation part: 46 mm
Length of the heat radiation part in the axial direction of the base: 4 mm

EMBODIMENT 3

Under the conditions described below, a lamp provided with a base according to embodiment 3 with the arrangement described in FIGS. 4(*a*), & 4(*b*) was produced.

(Filament lamp)
Arc tube: material: silica glass
total length: 150 mm
outside diameter: 27 mm
inside diameter: 25 mm
Filament: material: tungsten
Total length of light emitting part: 34 mm
Inner lead pin: material: tungsten
Metal foil: material: molybdenum
Filler: krypton gas, nitrogen and halogen compound
Rated voltage: 120 V
Rated power consumption: 2000 W The base according to embodiment 3 has the same basic arrangement and the same dimensions as the base in the above described embodiment 2. Furthermore, the lamp holding part of the base is provided with a host of radiating fins.

Figure 7:
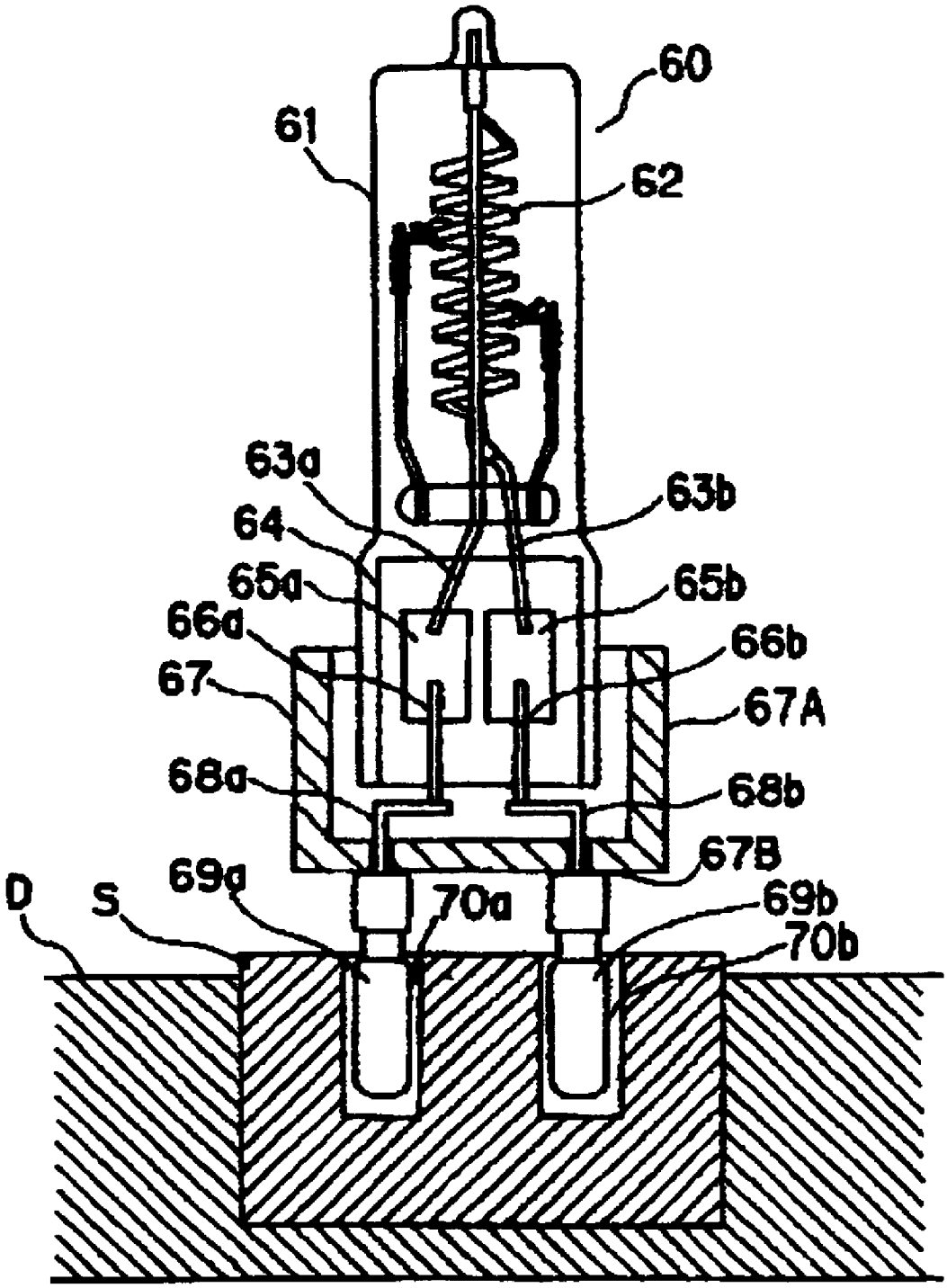
Fig. 7 (Prior Art)
FIG. 7 is a front view of a prior art lamp with a base.

COMPARISON EXAMPLES (1) A lamp was produced as a comparison example 1 under the same conditions as in embodiment 1, except for a change to the base shown in FIG. 7 for the prior art lamp.

(2) A lamp was produced as a comparison example 2 under the same conditions as in embodiment 3 except for a change to the base shown in FIG. 7 for the prior art lamp.

(Test example)

In the lamps according to embodiments 1 to 3 and comparison examples 1 and 2, a thermocouple for temperature measurement was installed in the hermetically sealed portion and the lamp cemented to the base. Furthermore, another thermocouple was installed in the feed components of the base. The heating apparatus of the lamp was an aluminum plate with an opening for insertion of a socket, the socket was installed, and thus, a simple heating apparatus for test purposes was arranged. These lamps provided with a base were operated without interruption with an ac voltage of 120 V for 1.5 hours and the temperatures of the feed components of the base and of the hermetically sealed portion of the lamp were measured.

The result is shown below using Table 1. In Table 1, under Remarks, the arrangement of the base is shown, "o" indicating that the pertinent component is provided. Here, to facilitate understanding, there is a column for the respective rated power consumption of the lamp.

TABLE 1

| | Rated power consumption of the lamp (W) | Temperature of the feed components of the base (° C.) | Remarks | | |
|---|---|---|---|---|---|
| | | | heat insulator | heat radiation part | radiating fin |
| Embodiment 1 | 500 | 280 | ○ | — | — |
| Embodiment 2 | 500 | 268 | ○ | ○ | — |
| Comparison example 1 | 500 | 290 | — | — | — |
| Embodiment 3 | 2000 | 260 | ○ | ○ | ○ |
| Comparison example 2 | 2000 | 300 | — | — | — |

In the lamps according to embodiments 1, 2 and comparison example 2 with a rated power consumption of 500 W, in the lamp provided with the base according to comparison example 1, which is a conventional product, the temperature of the feed components of the base reached 290° C. Therefore, it exceeded the heat stability temperature of 280° C. For the lamp provided with a base in embodiments 1 and 2 of the invention, conversely, the temperature of the feed components of the base was able to drop to the heat stability temperature for embodiment 1 and to below it for embodiment 2.

In the lamps according to embodiment 3 and comparison example 2 with a rated power consumption of 2000 W, in the lamp provided with the base according to comparison example 2, which is a conventional product, the temperature of the feed components of the base reached 300° C. Therefore, it exceeded the heat stability temperature of 280° C. On the other hand, for the lamp provided with a base according to embodiment 3 of the invention, conversely, the temperature of the feed components of the base was 260° C., which is below the heat stability temperature.

What is claimed is:

1. Lamp arrangement with a lamp and a base which is located on a hermetically sealed portion of the lamp, the base comprising:

a hollow cylindrical lamp holding part which holds and secures the hermetically sealed portion of the lamp;

a bottom end which borders a lower end of the lamp holding part and which faces away from the lamp; and feed components which project from a back end face of the bottom end which end face faces away from the lamp, and a heat insulator is formed between the lamp holding part and the bottom end by which a lesser amount of heat is transferred in an axial direction toward the bottom end of the base than is transferred away from the bottom end of the base;

wherein the heat insulator is formed by a locally reduced wall thickness of the lamp holding part.

2. Lamp arrangement as claimed in claim 1, wherein the bottom end of the base is formed as a heat radiation part.

3. Lamp arrangement as claimed in claim 1, wherein radiating fins are provided on the lamp holding part.

* * * * *